United States Patent [19]

Marukawa et al.

[11] 4,280,838

[45] Jul. 28, 1981

[54] PRODUCTION OF CARBON STEEL AND LOW-ALLOY STEEL WITH BOTTOM BLOWING BASIC OXYGEN FURNACE

[75] Inventors: Katsukiyo Marukawa; Isao Yamazaki; Syoji Anezaki, all of Ibaraki; Tsutomu Kajimoto, Wakayama, all of Japan

[73] Assignee: Sumitomo Metal Industries, Ltd., Japan

[21] Appl. No.: 148,530

[22] Filed: May 9, 1980

[30] Foreign Application Priority Data

May 24, 1979 [JP] Japan ..... 54-64221
May 24, 1979 [JP] Japan ..... 54-64222

[51] Int. Cl.[3] ..... C21C 5/32; C21C 5/34

[52] U.S. Cl. ..... 75/60; 75/59; 75/51; 75/52

[58] Field of Search ..... 75/60, 59, 52, 51

[56] References Cited

U.S. PATENT DOCUMENTS

| | | | |
|---|---|---|---|
| 3,854,932 | 12/1974 | Bishop | 75/60 |
| 3,970,446 | 7/1976 | Kolb | 75/52 |
| 3,971,655 | 7/1976 | Takashima | 75/60 |
| 4,001,009 | 1/1977 | Bauer | 75/60 |
| 4,047,936 | 9/1977 | Chang | 75/60 |
| 4,089,677 | 5/1978 | Spenceley | 75/51 |
| 4,178,173 | 12/1979 | Gorges | 75/52 |
| 4,195,985 | 4/1980 | Brotzmann | 75/59 |

*Primary Examiner*—P. D. Rosenberg
*Attorney, Agent, or Firm*—Stevens, Davis, Miller & Mosher

[57] ABSTRACT

A method of producing carbon steel and low-alloy steel in a basic oxygen furnace is disclosed, in which a blow of the bottom-blowing gas predominantly comprised of carbon dioxide is introduced into a molten metal through at least one nozzle provided in the bottom or side wall of said basic oxygen furnace at least partly during the period of time from the beginning of blowing to the tapping of the melt, and the flow rate of the bottom-blowing gas is 1/200 - 9/100 the rate of oxygen impinged upon the melt through a lance.

13 Claims, 2 Drawing Figures

PRODUCTION OF CARBON STEEL AND LOW-ALLOY STEEL WITH BOTTOM BLOWING BASIC OXYGEN FURNACE

FIELD OF THE INVENTION

This invention relates to the production of carbon steel and low-alloy steels with a bottom blowing basic oxygen furnace (hereinafter sometimes referred to as "bottom blowing BOF"). More particularly, this invention relates to a steel making process in which a blow of gas is injected into a melt so as to promote the agitation of the melt during top-blowing of pure oxygen through a lance.

BACKGROUND OF THE INVENTION

In the oxygen top-blowing steel making process, molten iron, scrap and other starting materials are charged into a converter and then refining of steel is carried out while blowing pure oxygen onto the charge melt through an oxygen lance. At an early or intermediate stage of the blowing, the oxygen vigorously reacts to the melt still containing a substantial level of carbon so that the generanion of carbon monoxide is sufficient to bring about thorough agitation of the melt.

However, since the amount of carbon in the melt decreases at an end stage of the blowing, the generation of carbon monoxide rapidly diminishes and the reaction between the molten steel and slag rapidly goes down. Due to such decrease in decarburizing efficiency of oxygen, i.e. decrease in the proportion of oxygen which has been used to effect decarburization to the total amount of oxygen blown into the melt, the presence of excess oxygen is unavoidable resulting in oxidation of iron far beyond the equilibrium level. In addition, due to insufficient agitation of the molten steel and slag, there will be a temperature difference between them, resulting in a dephosphorizing reaction proceeding in an adverse direction. This is caused by less agitation of the molten metal. Therefore, it has been proposed to provide an oxygen converter with an electromagnetic agitator. It has also been proposed to add scrap iron to the melt at the last stage of blowing to generate a turbulence of the melt due to a temperature difference between the scrap and melt. However, these proposals have never been practiced because they require a high construction cost and their effect is not so large as expected.

Furthermore, it has been proposed to rotate or swing the oxygen blowing lance to provide additional agitation of molten metal and slag. But this promotes the agitation of slag, not of the molten steel.

In order to eliminate these prior art disadvantages, it has also been proposed to inject a blow of gas into a molten metal through the bottom while pure oxygen is blown onto the melt through a lance. Examples of the gases to be injected into the melt are limited to an inert gas such as argon and a neutral gas such as nitrogen. However, since argon is very expensive, and a relatively large amount must be blown into the melt in the bottom blowing so as to thoroughly agitate the melt, a sharp increase in cost is unavoidable. The introduction of pure nitrogen or a gas predominantly comprised of nitrogen, such as a compressed air will increase the nitrogen content of the melt. Thus, the blowing of nitrogen is not practical, either.

French Pat. No. 1,151,053 and U.S. Pat. No. 3,854,932 disclose the bottom blowing of various kinds of gases, including argon, steam, air carbon oxide, etc. However, U.S. Pat. No. 3,854,932, for example, is directed to the production of stainless steel, so that the main purpose is to suppress the oxidation of chromium. Thus, it is necessary to carry out the process of this invention under subatmospheric conditions. In addition, it treats these gases as being equivalent. Furthermore, since the French patent teaches the bottom blowing of a relatively large amount of gas into the melt, the process disclosed therein is less economical.

A recent development in this field is the "Q-Bop" process, in which instead of top-blowing of pure oxygen, the oxygen is blown into the molten metal through nozzles provided at the bottom of the converter. Since the "Q-Bop" process employs the bottom-blowing of pure oxygen gas instead of using the top-blowing thereof, it is necessary to blow gas such as propane for protecting the nozzles. Consequently, in this case, too, a relatively large amount of blowing gas must be injected into the molten metal. The "uniform mixing time" hereinafter described in detail is about 10 seconds.

SUMMARY OF THE INVENTION

The primary object of this invention is to provide a method of producing carbon steel and low-alloy steel with a basic oxygen furnace.

Another object of this invention is to provide an economical method of violently agitating a melt using a small amount of carbon dioxide gas as the bottom blowing gas in a bottom-blowing BOF.

Still another object of this invention is to provide a method of producing carbon steel and low-alloy steel with improved tapping yield.

DETAILED DESCRIPTION OF THE INVENTION

This invention resides in a method of producing carbon steels and low-alloy steels in a basic oxygen furnace, characterized in that a blow of gas predominantly comprised of carbon dioxide is introduced into the molten metal through at least one nozzle provided in the bottom or side wall of said basic oxygen furnace at least partly during the period of time from the beginning of blowing to the tapping of the melt, the flow rate of the bottom blowing gas being less than 9/100, preferably less than 5/100 the rate of oxygen impinged upon the melt through a lance.

The blowing gas predominantly comprised of carbon dioxide may be the one comprising more than 50% by volume of carbon dioxide, including an exhaust gas from a metal refining furnace such as a steel converter and a purified or concentrated gas derived from a combustion gas of a heating furnace. Other components of the bottom-blowing gas may be nitrogen, oxygen, etc. The more nitrogen there is in the blowing gas, the greater the nitrogen content of the melt. In case of producing the usual rimmed steels, nitrogen in an amount of less than 50% by volume may be present in the blowing gas without bringing in any troubles. But it is preferable to use a gas containing less than 20% by volume of nitrogen if it is intended to produce a low-nitrogen steel. It is to be noted, however, that if a relatively large amount of nitrogen is blown into the melt, the nitrogen will be almost completely removed until the carbon content reduces to 0.5%. This is because the denitrifying reaction takes place vigorously when the carbon content is more than 0.5%. Thus, nitrogen gas may be blown into the melt instead of carbon dioxide gas until the carbon content reduces to 0.5%. After the carbon content reduces to 0.5% or less, the bottom blowing should be carried out in accordance with this invention.

In addition, a mushroom deposition about 5–15 cm thick will be sometimes formed at the tip of the nozzle in practicing the method of this invention because of the temperature difference found between the nozzle cooled with the blown gas and the melt surrounding it. It is supposed that the deposition is formed at the beginning of operation and is mainly comprised of slag. The formation of such a deposition at the tip of a nozzle makes difficult the blowing of gas in a predetermined amount. In order to avoid such a difficulty, it is advisable to increase the pressure or flow rate of the blowing gas to such a level that the deposition is made porous due to the passing of the gas through the nozzle. It is also advisable to incorporate a small amount of oxygen in the blowing gas so as to utilize its generation of heat in accordance with the equation:

$$2CO+O_2=2CO_2$$

According to this invention, the bottom blowing is applied at least partly during the period of time of from the beginning of the blowing of oxygen through a lance to the tapping of the refined molten steel. The bottom blowing rate may be varied during the process, e.g. depending on the proceeding of the steel making reaction in the converter. For example, it is preferable to increase the blowing rate at a final stage of the top-blowing so as to compensate for the decrease in agitation due to the going down of the decarburizing reaction. Therefore, an effective refining reaction can be continued successfully to the end, resulting in a remarkable reduction in the amount of gas used.

The blowing of carbon dioxide is preferably carried out by way of at least one nozzle provided in the bottom or in the side wall of the oxygen steel converter.

The advantages obtained by using carbon dioxide as a blowing gas is not only that it is less expensive than an inert gas such as argon, but also that carbon dioxide increases twice in volume when it is added to the melt in accordance with the equation: $C+CO_2=2CO$, bringing about violent agitation of the melt. In other words, less gas is required to achieve the same effect of agitation in comparison with argon or nitrogen. This reduction in amount of gas used means that it is possible to simplify the equipment including piping required to blow gas into the molten steel in accordance with this invention. This is markedly advantageous from a practical viewpoint.

According to this invention the flow rate of the bottom blowing gas is limited to less than 9/100, preferably less than 5/100 the rate of oxygen impinged upon the melt through a lance. This means that a relatively small amount of gas is injected into the melt through the bottom blowing. If the bottom blowing gas is injected into the melt in an amount of more than 9/100 the rate of oxygen blown through a lance, the agitation takes place so vigorously that reduction in tapping yield is substantial due to much splashing of the melt. On the other hand, if the amount of the bottom blowing gas is less than 1/200 the top-blowing gas, the necessary agitation of the melt cannot be obtained.

In addition, the amount of the bottom-blowing gas may preferably be restricted on the basis of the amount of molten metal to be treated, independently from the blowing rate of pure oxygen through a lance. According to this embodiment, the amount of gas to be injected into the melt is precisely regulated or adjusted so that the uniform mixing time is 20 seconds or more.

The uniform mixing times means the time which is required to uniformly mix the molten steel and molten slag only by the bottom blowing. The uniform mixing time is a factor introduced by K. Nakanishi et al ("Ironmaking and Steelmaking" (1975) 3, 193) and is defined as follows.

Uniform Mixing Time $\tau=800\times\epsilon^{-0.4}$ (sec.)

$$\dot{\epsilon} = 28.5\frac{Q}{W_g}\times T\times\log(1+Z/148)\ \text{(Watt/ton)}$$

wherein $Q$=gas flow rate ($Nm^3$/min)

$W_g$=amount of molten steel (ton)

$T$=bath temperature (°K.)

$Z$=depth of the bath (cm)

In a preferred embodiment, the uniform mixing time is more than 30 seconds. If the amount of gas falls within the limitation defined above, then thorough agitation will be obtained. If the uniform mixing time is less than 20 seconds, the agitation between molten steel and molten slag occurs so vigorously that the reduction of iron oxide in the molten slag proceeds excessively, reducing the content of the iron oxide, which is effective for dephosphorization of the molten steel. Furthermore, if the uniform mixing time is less than 15 seconds, much leakage of the molten steel from the vessel takes place, resulting in less tapping yield of steel.

If the uniform mixing time is longer than 70 seconds, i.e. the amount of the bottom blowing gas is much reduced, no agitation is effected, and the blowing process is substantially the same as the conventional oxygen steel making process with top-blowing. This results in remarkable increase in the amount of total iron in the molten slag, and a decrease in tapping yield. Thus, it is desirable to adjust the uniform mixing time to 20–70 seconds.

It can be said on the basis of experiments that, for example, in case of the bath depth being 250 cm the uniform mixing time of 20 seconds corresponds to the bottom blowing at a rate of 0.5 $Nm^3$/min per ton of molten steel, and uniform mixing time of 70 seconds to 0.02 $Nm^3$/min per ton of molten metal.

This invention is particularly applicable to produce carbon steel, such as rimmed steel, killed steel, etc., and low-alloy steel. More particularly, this invention provides a satisfactory method of producing low-carbon steel, such as carbon steel containing less than 0.3% C.

Comparing the conventional process with this invention method, the following advantages of this invention are noted.

Since the oxidation of iron, manganese etc. is significantly inhibited, the yield of iron is markedly improved and the amount of ferro-alloy used may be decreased. In addition, since the temperature difference between the molten steel and the slag diminishes, the dephosphorizing is promoted. Another advantage of this invention is that the blowing gas, i.e. carbon dioxide, is abundant in a steel making plant and is available at low cost. This is an economical aspect of this invention. Thus, this invention has also a practical value in the light of the present day demand for saving energy and preventing the discharge of pollutants into the environment.

As hereinbefore mentioned, the method of this invention can easily be practiced in the usual steel making process by installing at least one nozzle in the conventional basic oxygen furnace. Of course, the application of this invention is not limited to the existing oxygen converters. As far as the combination of the top-blowing and the bottom blowing is possible, this invention is applicable to any type of metal refining furnaces.

PREFERRED EMBODIMENTS OF THE INVENTION

Figure 1:
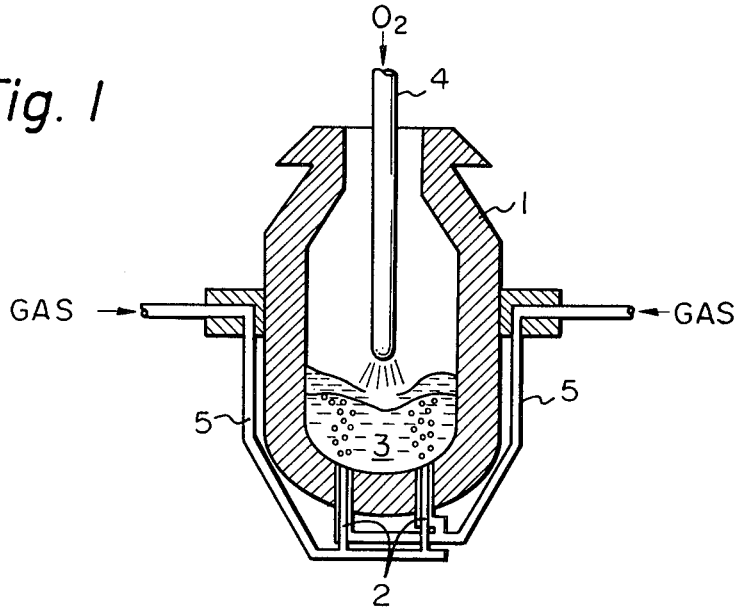
FIG. 1 is an elevational side view diagrammatically showing the bottom-blowing BOF utilized in this invention.

According to this invention, molten iron, iron scrap and other starting materials are charged into a bottom-blowing BOF, i.e. converter 1. Two to ten coaxial nozzles 2 are provided at the bottom of this oxygen converter. During operation of the converter, pure oxygen is impinged onto the surface or the underneath of the molten metal 3 through a lance 4 while the bottom-blowing gas predominantly comprised of carbon dioxide is blown into the molten metal by way of the nozzles 2. The nozzles are arranged in two rows in this example. It is to be noted, however, that the structure, arrangement and number of the nozzles are not limited to particular ones.

In a preferred embodiment of this invention, a blow of gas predominantly comprised of carbon dioxide and supplied by way of conduits 5 is introduced into the molten metal 3 through coaxial nozzles 2 provided in the bottom of said basic oxygen furnace at least partly during the period of time from the beginning of blowing to the tapping of the melt and the flow rate of the bottom-blowing gas is less than 5/100 the rate of oxygen blown onto the melt through lance 4.

In another embodiment of this invention, the uniform mixing time is adjusted to 20 seconds or more.

This invention will be further described in conjunction with the working examples, in which Examples 1 and 2 show the effect of this invention and Example 3 shows the influence of the uniform mixing time of the blowing gas on the refining efficiency of this invention.

EXAMPLE 1

A conventional oxygen converter with the capacity of 250 tons was used to carry out this invention. Four nozzles 10 mm in diameter were installed at the bottom of the converter. Into this converter, as main starting materials, 215 tons of molten iron and 35 tons of scrap iron, and, as other starting material, 3 tons of quick lime were charged. The composition of the molten iron was, by weight percent, 4.63% C, 0.48% Si, 0.45% Mn, 0.123% P, 0.0018% S, 0.0038% N and the balance iron and incidental impurities. The temperature thereof was 1385° C.

The gas blowing from the top and from the bottom was carried out as in the following.

Figure 2:
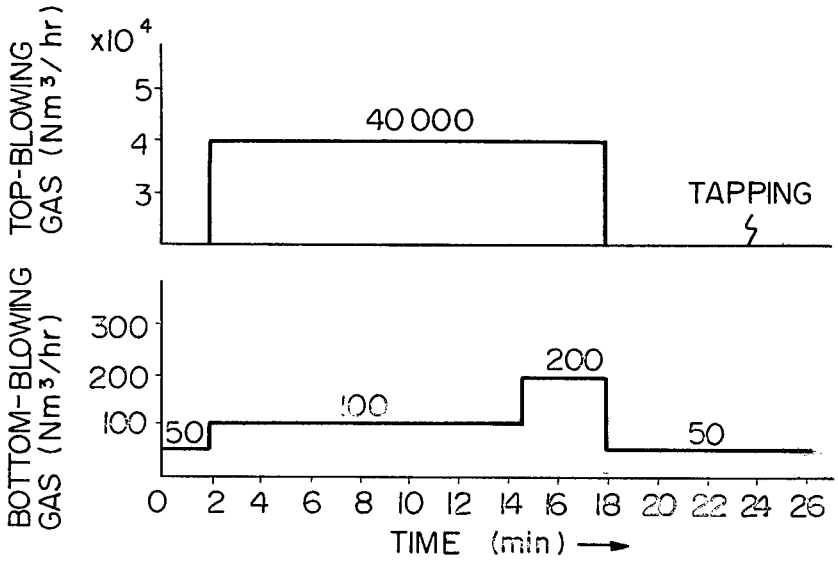
FIG. 2 is a graph showing the blowing patterns of this invention.

The top-blowing of oxygen was carried out at a flow rate of 40,000 $Nm^3/hr$ in accordance with the flow pattern shown in FIG. 2. The bottom blowing was also carried out following the flow pattern shown in FIG. 2. As shown in FIG. 2, the bottom blowing was initiated at a flow rate of 50 $Nm^3/hr$ and the rate was increased to 100 $Nm^3/hr$ when the top-blowing of oxygen was initiated. At the end stage of the blowing, the rate of the bottom blowing was increased to 200 $Nm^3/hr$ and was then reduced to 50 $Nm^3/hr$ after the top-blowing was finished. The bottom-blowing gas was an exhaust gas obtained from an oxygen converter and comprised, by weight percent, 18% CO, 63% $CO_2$, 16% $N_2$, and 3% $H_2$.

For the purpose of comparison, a conventional oxygen steel making process was also carried out using the same oxygen converter. The composition of the starting material charged into the converter and the manner of top-blowing were the same as in the above. In this case, however, the bottom blowing was not applied. The intended product steel was low-carbon rimmed steel. Table 1 below summarizes the final composition of the molten steel.

TABLE 1

| | Composition (% by weight) | | | | | Tem. | T.Fe in slag | Tapping yield |
|---|---|---|---|---|---|---|---|---|
| | C | Mn | P | S | N | (°C.) | (%) | (%) |
| this invention | 0.063 | 0.16 | 0.017 | 0.012 | 0.0025 | 1625 | 13.8 | 96.3 |
| conventional | 0.065 | 0.12 | 0.021 | 0.015 | 0.0011 | 1618 | 19.5 | 95.8 |

As is apparent from the data shown in Table 1 above, the composition of the product steel of the method of this invention falls within that of low-carbon rimmed steel and also shows a remarkably efficient dephosphorization and tapping yield.

EXAMPLE 2

In this example, Example 1 was repeated except that various kinds of gases were used as the bottom-blowing gas.

As hereinbefore mentioned, the bottom-blowing gas of this invention may be an exhaust gas discharged from an iron making plant, or a steel making plant. In this example, therefore, such kind of exhaust gas was used as the bottom blowing gas. Gas No. 1 was derived from an exhaust gas discharged from an oxygen converter and was made rich in carbon dioxide. Gas No. 2 was derived from an exhaust gas discharged from a hot stove and was made rich in carbon dioxide (Table 2).

The final composition of the molten steel in each run is summarized in Table 3 below.

TABLE 2

| Gas No. | Gas composition (% by volume) | | | | |
|---|---|---|---|---|---|
| | $CO_2$ | CO | $N_2$ | $H_2$ | $O_2$ |
| 1 | 95 | 0 | 5 | 0 | 0 |
| 2 | 52.6 | 0 | 43 | 3.2 | 1.2 |

TABLE 3

| Gas No. | Final composition (% by weight) | | | T.Fe in slag | Temperature |
|---|---|---|---|---|---|
| | C | Mn | N | (%) | (°C.) |
| 1 | 0.058 | 0.15 | 0.0019 | 14.2 | 1632 |
| 2 | 0.063 | 0.15 | 0.0085 | 14.5 | 1619 |

According to this invention, an exhaust gas discharged from the oxygen converter may be used as the bottom-blowing gas. If the nitrogen content of the exhaust gas is below 50% by volume, the nitrogen content of the resulting steel product is acceptable. In addition, according to this invention, the agitation of the melt was effected thoroughly, resulting in sufficient degree of decarburization and dephosphorization to make the method of this invention practical.

EXAMPLE 3

The following starting materials were charged into an oxygen converter shown in FIG. 1. The capacity of the converter was 250 tons and the bath depth was 250 cm. Two concentric nozzle were provided at the bottom (the inner nozzle was 12.7 mm in inner diameter and 15.4 mm in outer diameter, the slit width was 1.15 mm, and the outer nozzle was 17.7 mm in inner diameter and 19.1 mm in outer diameter.

| | |
|---|---|
| Molten iron: | 220 tons |
| The [Mn] is about 0.40% and [P] is about 0.150% in molten iron. | |
| Scrap iron: | 30 tons |
| Other materials: | |
| quick lime | 9 tons |
| iron ore | 4.5 tons |
| light dolomite | 3.0 tons |
| fluorite | 0.2 ton |
| converter slag | 1.8 tons |

According to the method of this invention, various kinds of bottom blowing gas were injected into the melt while top-blowing pure oxygen through a lance. The blowing conditions and the resulting uniform mixing time are summarized in the following Table 4.

TABLE 4

| Run No. | top-blowing flow rate[A] ($Nm^3$/min) | bottom-blowing gas composition (by volume) | bottom-blowing flow rate[B] ($Nm^3$/min) | B/A | bath temp. (°C.) | uniform mixing time (second) | T.Fe in slag (%) | final carbon content (%) | tapping yield (%) |
|---|---|---|---|---|---|---|---|---|---|
| 1 | 600 | $Ar:CO_2$ = 40:60 | 20 (32) | 3.3/100 | 1600 | 33.7 | 11 | 0.05 | 96.2 |
| 2 | 600 | $CO:CO_2$ = 40:60 | 7 (11.2) | 1.2/100 | 1600 | 51.2 | 13 | 0.05 | 96.0 |
| 3 | 600 | none | none | — | 1600 | — | 20 | 0.05 | 95.5 |

Note:
In Runs 1 and 2, the carbon dioxide injected increases twice in volume in accordance with the following equation: $CO_2 + C = 2CO$. Thus, the flow rate of the bottom blowing gas in Runs 1 and 2 were, in fact, 32 $Nm^3$/min and 11.2 $Nm^3$/min, respectively.

As is apparent from the foregoing, the method of this invention is very practical, since the existing oxygen converter may be utilized merely by installing a nozzle at the bottom or at the side wall of it. In addition, the gas to be used as the bottom blowing gas may be an exhaust gas obtained from the converter with or without addition of carbon dioxide. Thus, the method of this invention is easily applicable to the existing oxygen converter and will bring about practical advantages.

What is claimed is:

1. A method of producing carbon steel and low-alloy steel in a basic oxygen furnace comprising preparing a molten metal suitable for producing the steel in said basic oxygen furnace, carrying out the top-blowing of oxygen gas through a lance and bottom blowing and then tapping the resulting molten steel, characterized in that a blow of the bottom-blowing gas predominantly comprising carbon dioxide is introduced into the molten metal through at least one nozzle provided in the bottom or side wall of said basic oxygen furnace at least partly during the period of time from the beginning of blowing to the tapping of the melt, the flow rate of the bottom blowing gas being 1/200–9/100 the rate of oxygen impinged upon the melt through said lance.

2. A method as defined in claim 1, in which the nitrogen content of said bottom blowing gas is limited to not more than 20% by volume.

3. A method as defined in claim 1, in which the bottom blowing gas contains a small amount of oxygen.

4. A method of producing carbon steel and low-carbon steel in a basic oxygen furnace comprising preparing a molten metal suitable for producing said steel in said basic oxygen furnace, carrying out the top-blowing and bottom-blowing and then tapping the resulting molten steel, characterized in that a blow of the bottom-blowing gas predominantly comprising carbon dioxide is introduced into the molten metal through at least one nozzle provided in the bottom or side wall of said basic oxygen furnace at least partly during the period of time from the beginning of blowing to the tapping of the melt, the amount of the bottom-blowing gas being adjusted so that the uniform mixing time is longer than 20 seconds.

5. A method as defined in claim 4, in which the flow rate of the bottom blowing gas is 1/200–9/100 the rate of oxygen impinged upon the melt through a lance.

6. A method as defined in claim 4 or 5 in which the uniform mixing time is 20–70 seconds.

7. A method as defined in claim 6, in which the uniform mixing time is 30–70 seconds.

8. A method as defined in claim 1, in which a blow of nitrogen gas is introduced instead of said bottom-blowing gas until the carbon content of the molten metal reduces to about 0.5%.

9. A method as defined in claim 1, in which the amount of said bottom-blowing gas is increased at a final stage of a refining process so as to compensate for the decrease in agitation due to the decreasing of decarbonizing reaction.

10. A method as defined in claim 4, in which a blow of nitrogen gas is introduced instead of said bottom-blowing gas until the carbon content of the molten metal reduces to about 0.5%.

11. A method as defined in claim 4, in which the amount of said bottom-blowing gas is increased at a final stage of a refining process so as to compensate for the decrease in agitation due to the going down of decarbonizing reaction.

12. The method of claim 1, wherein the blow of bottom-blowing gas consists essentially of carbon dioxide.

13. The method of claim 4, wherein the blow of bottom-blowing gas consists essentially of carbon dioxide.

* * * * *